United States Patent [19]

Allsop

[11] 4,192,424

[45] Mar. 11, 1980

[54] SHOE DISPLAY APPARATUS

[76] Inventor: Jon I. Allsop, 3157 Sunset Way, Bellingham, Wash. 98225

[21] Appl. No.: 825,061

[22] Filed: Aug. 16, 1977

[51] Int. Cl.[2] ..... A47F 7/08

[52] U.S. Cl. ..... 211/37; 248/225.4; 248/295 A

[58] Field of Search ..... 211/34, 35, 36, 37, 211/38; 248/124, 125, 221.4, 222.1, 245, 295 A, 295 R, 310

[56] References Cited

U.S. PATENT DOCUMENTS

| | | | |
|---|---|---|---|
| 723,677 | 3/1903 | Kade | 248/245 |
| 750,245 | 1/1904 | Arpin | 248/310 |
| 756,648 | 4/1904 | Kade | 248/245 |
| 2,208,002 | 7/1940 | Hartner | 12/120.5 |
| 2,566,656 | 9/1951 | David | 12/120.5 X |
| 2,677,519 | 5/1954 | Hobson | 248/125 |
| 2,852,222 | 9/1958 | Bogar | 248/295 R |
| 2,859,710 | 11/1958 | Elsner | 403/252 X |
| 2,893,666 | 7/1959 | Cousins | 248/125 X |
| 2,916,234 | 12/1959 | Bogar | 248/222.1 X |
| 3,015,177 | 1/1962 | Hembd | 248/222.1 X |
| 3,094,305 | 6/1963 | Lohrman | 248/222.1 |
| 3,273,847 | 9/1966 | Berman | 248/243 |
| 3,415,477 | 12/1968 | Kondur | 248/245 X |
| 3,425,564 | 2/1969 | Allsop | 211/37 |
| 3,462,110 | 8/1969 | Cheslock | 248/125 X |
| 3,478,890 | 11/1969 | Allsop | 211/37 |
| 3,619,837 | 11/1971 | Smolka | 12/120.5 |
| 3,811,575 | 5/1974 | Boeghold | 211/148 |
| 3,870,153 | 3/1975 | Allsop et al. | 211/37 |
| 3,958,695 | 5/1976 | Allsop et al. | 211/37 |

FOREIGN PATENT DOCUMENTS

| | | | |
|---|---|---|---|
| 2731514 | 2/1978 | Fed. Rep. of Germany | 248/295 A |

*Primary Examiner*—William H. Schultz

[57] ABSTRACT

An upright mounting post supporting a plurality of outwardly extending shoe display units. Each display unit comprises a platform having two side by side upwardly facing display surfaces to carry a pair of shoes in an upright position. At the outer end of each unit, there is a vertically adjustable toe-securing device, and a pair of heel engaging devices are positioned at the inner end of the platform. The platform is mounted to the post by means of a pair of resiliently mounted outwardly extending flanges which fit into a slideway in the form of a pair of opposed slots provided by the mounting post. The platform can be moved upwardly or downwardly to any desired position, and a cam-like locking device is positioned between the resiliently mounted flanges to press the flanges into locking engagement with the slots and hold the platform in the desired position.

43 Claims, 11 Drawing Figures

FIG. 1
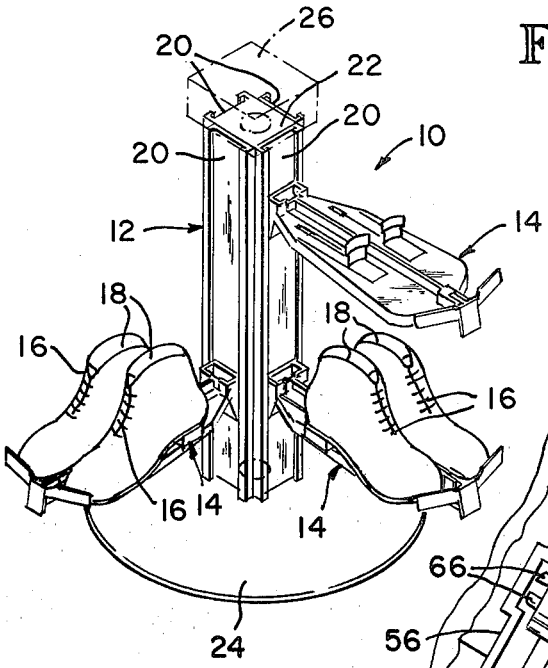
FIG. 2
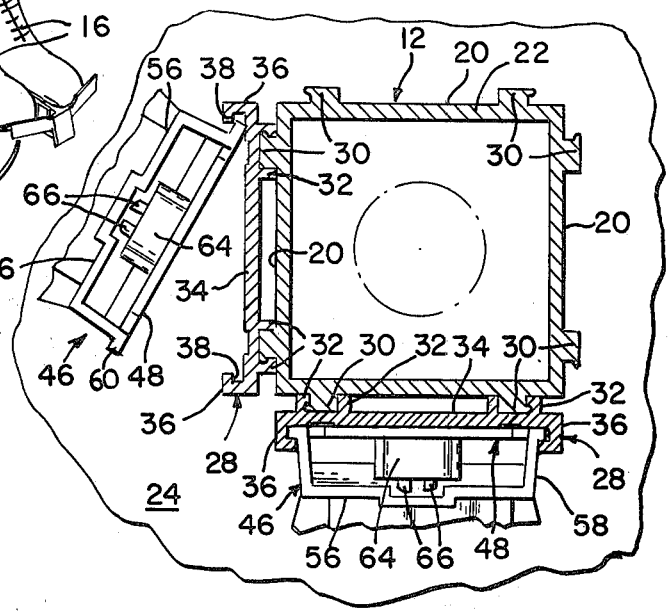
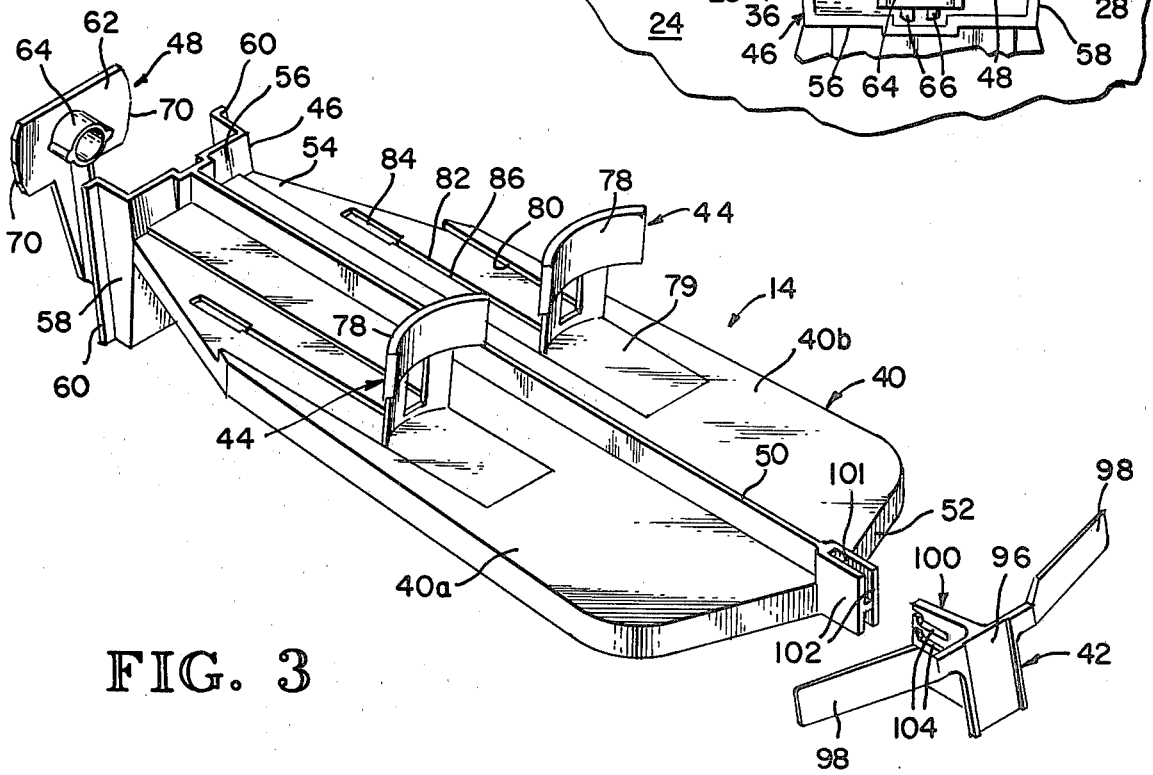
FIG. 3

FIG. 4
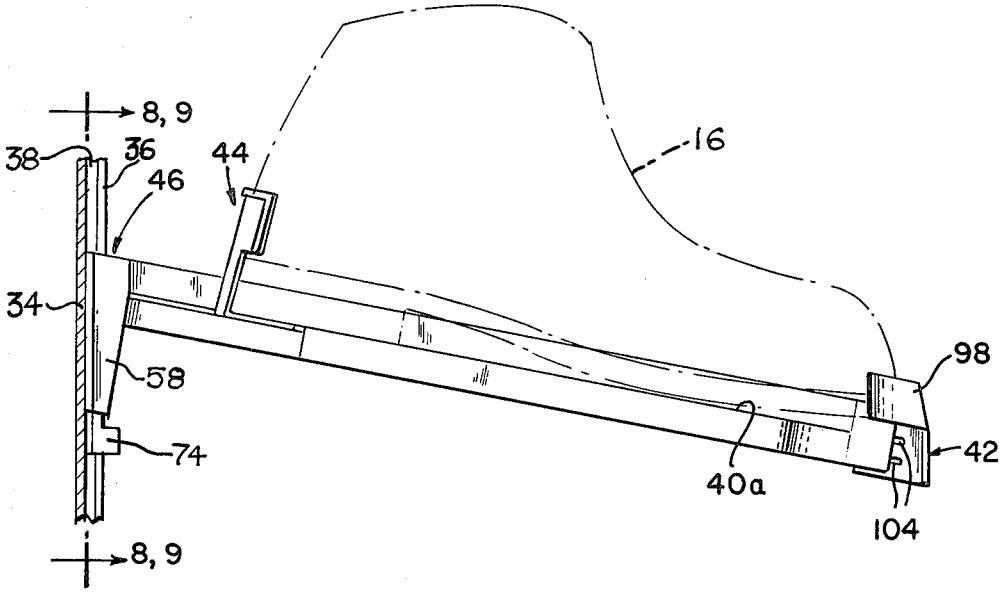
FIG. 5
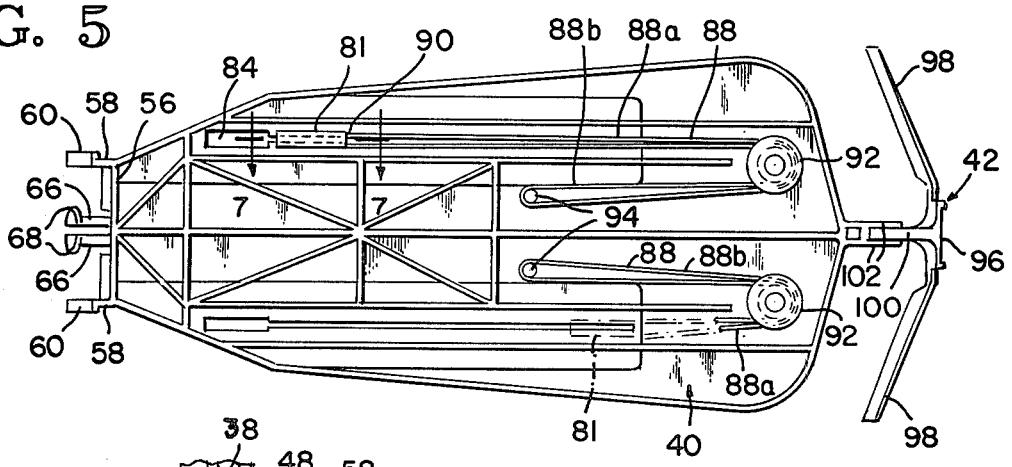
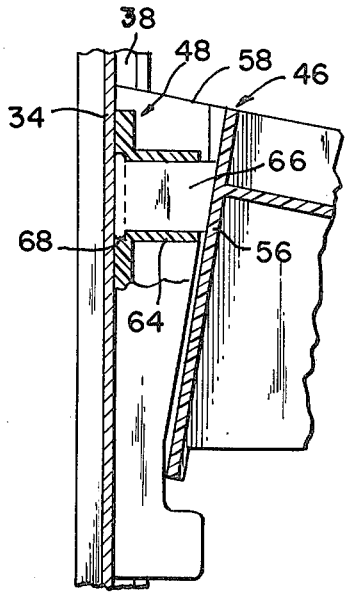
FIG. 6
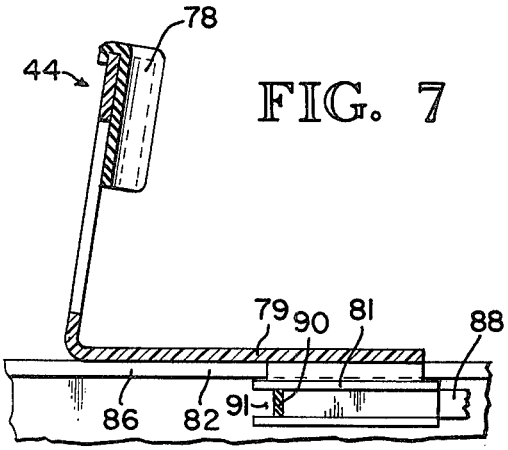
FIG. 7

SHOE DISPLAY APPARATUS

BACKGROUND OF THE INVENTION

A. Field of the Invention

The present invention relates to a display apparatus, and more particularly to a display apparatus especially adapted to display pairs of shoes in an upright position.

B. Brief Description of the Prior Art

For many years shoes have commonly been displayed in retail stores simply by placing the shoes on a horizontal shelf which is sometimes slanted to provide a better view of the shoes. To display the shoes in a more attractive manner, there have been in more recent years devices which mount the shoes to support brackets, which in turn are mounted to a center post. One such device is shown in U.S. Pat. No. 3,425,564, Allsop, where there is shown a center post with a plurality of sets of vertically spaced mounting brackets. Each pair of shoes which is to be displayed is mounted to an individual support frame in a manner that the soles of the shoes of each pair are facing one another. Then the frame is positioned between a vertically adjacent pair of brackets so that each pair of shoes extends outwardly from the center post, with the top of each shoe facing laterally. A quite similar apparatus is shown in U.S. Pat. No. 3,958,695, Allsop, et al.

Another approach to displaying pairs of shoes by means of a center mounting structure is shown in U.S. Pat. No. 3,478,890, Allsop. This patent discloses a "lazy-Susan" shoe support where the shoes are mounted in holding frames which are, in turn, vertically positioned against side faces of the lazy-Susan structure.

While the patents noted above do provide quite desirable means for displaying shoes, it is believed that there is also a requirement to provide display apparatus which is especially adapted to display shoes in a manner that the pairs of shoes are placed in side-by-side relationship with the upper portion of the shoes facing upwardly, with this apparatus being sufficiently versatile to properly support and display shoes of greatly varying styles, sizes and configurations. It is an object of the present invention to satisfy this requirement in an especially effective manner.

With regard to the manner in which display units of the present invention are mounted to a center post, the following patents, while not relating directly to shoe display apparatus, are noted in the prior art. U.S. Pat. No. 723,677, Kade, shows a bracket, such as that used to support a shelf, having a pair of mounting arms which fit in tongue-and-groove relationship with a support structure. A quite similar arrangement is shown in U.S. Pat. No. 756,648, also issued to Kade. Another device for mounting a bracket, such as a shelf bracket, is shown in U.S. Pat. No. 3,273,847, Berman, where a pair of hook-like extensions fit into matching slots in a mounting structure. A cam lock is provided to hold the bracket firmly in place.

With regard to the securing device in the present invention which holds the heel portions of the shoes, the following patents are noted. U.S. Pat. No. 3,619,837, Smolka, discloses an arrangement where there is a rubber band, doubled over on itself, engaging a securing device in a shoe tree. The two sections of the rubber band are arranged to pull in parallel relationship. U.S. Pat. No. 2,566,656, David, shows a tension spring which pulls a heel securing device into securing engagement. U.S. Pat. No. 2,208,002, Hartner, shows a shoe tree where an elongate rubber band is looped around a heel portion of a shoe.

The following patents are noted as showing various means of locking a mounting device. U.S. Pat. No. 2,859,710, Elsner, shows a mounting member which is rotated sideways to fit into recesses in a channel. U.S. Pat. No. 3,811,565, Boegehold, discloses a somewhat sophisticated arrangement where there are two plates, both of which fit into a channel (shown more clearly in FIG. 4 of the Boegehold patent). The two plates are moved vertically with respect to one another so that the ball elements which fit in recesses between the two plates are caused to wedge against opposite sides of their recesses to force the two plates apart and thus cause firm engagement with the channel member in which the plates are mounted. U.S. Pat. No. 3,462,110, Cheslock, shows a mounting device where there is a bolt with an oblong head which is placed in an upright channel. The oblong head of the bolt becomes wedged in the channel simply by tightening the nut which causes the head to rotate sideways into a wedging position. U.S. Pat. No. 3,415,477, Kondur, Jr., discloses a cam member which is urged by a spring toward a locking position against the sides of a channel in which it is mounted.

SUMMARY OF THE INVENTION

In the present invention, there is a display apparatus particularly adapted to display articles, such as pairs of shoes, in a manner that the shoes of each pair are in an upright position and in side by side relationship. This apparatus comprises a mounting post having a longitudinal axis and providing at least one vertical slideway (and preferably a plurality of vertical slideways) in the form of a pair of longitudinally extending opposed mounting slots.

There is at least one display unit adapted to be mounted to said post, and desirably a plurality of such units. Each display unit comprises a display platform which in its preferred form is adapted to support a pair of shoes thereon. Fixably connected to the inner end of the display platform is a mounting member which has a pair of oppositely and outwardly extending mounting flanges resiliently attached to the mounting member so as to be able to be deflected outwardly into engagement with the mounting slots of the mounting post.

There is locking means positioned to engage the mounting flanges. The locking means has a locking position where it presses the mounting flanges outwardly into locking engagement in the mounting slots, and a release position where it releases said flanges from locking engagement in the mounting slots to permit movement of the mounting member and its associated platform relative to the mounting post.

There is a first outer securing device mounted to the outer end of the platform by vertically adjustable mounting means so that the outer securing device can be vertically adjusted relative to the platform to engage in proper fashion one end of the article being displayed, such as the toe portions of shoes being displayed. There is a second inner securing device mounted to the platform at a location inwardly of the first securing device and arranged to engage an inner end of the article, such as the heel portions of the shoes being displayed.

In the preferred form of the present invention, where there are provided a plurality of display platforms mounted to the post, and with shoes being displayed on such platforms, the present invention particularly adapts itself to displaying shoes of varying sizes and shapes. First, the mounting location of each of the platforms can quite readily be adjusted simply by releasing the locking means and moving the platform to the desired vertical location, so that the spacing between the platforms can be controlled to accommodate shoes of different heights. Also, the outer securing means which engages the toe portion of the shoe can be quite conveniently vertically adjusted to accommodate various shapes of shoes for proper display of the shoes.

In the preferred form, the locking means has a plurality of locking positions about which the mounting flanges can be deflected outwardly to a greater or lesser degree to accommodate greater of lesser degrees of variation in the configuration of the mounting slots. The preferred form of the locking means is a rotatably mounted cam member having opposed cam faces engaging said mounting flanges. Each cam face has a plurality of opposed sets of locking faces spaced at varying distances from a point of rotation of the locking cam. Further, spacing means are provided to properly position the locking cam relative to the mounting member for proper engagement of the mounting flanges.

To operate the cam, there is a downwardly extending lever accessible from a position below the mounting means, whereby the locking cam can be conveniently moved between its locking and release positions, and yet the locking lever is inconspicuously placed. Desirably the locking cam is positioned in the upper portion of the mounting means to engage upper portions of the mounting flanges, whereby in addition to providing proper locking engagement of the flanges, the display platform is mounted securely in that downward rotation of the platform is resisted by the upper flange portions in the mounting slots.

The preferred configuration of the mounting means is that it comprises a body portion and two rearwardly extending webs. The two mounting flanges are mounted at the rear edge portions of the webs, and the webs are resiliently mounted to permit outward deflection of the mounting flanges.

The mounting means for the outer securing device comprises a pair of vertical plates connected to the platform and defining therebetween a vertical mounting recess. A locking bar is fixedly connected to the plate and extends across the recess. Arm means is connected to the outer securing device and adapted to fit into the mounting recess. The arm means is provided with a plurality of vertically spaced locking slots which may be selectively engaged by said locking bar for vertical adjustment in the mounting of the outer securing device.

The slots in the arm means separate the arm means into individual members, some of which are provided with a related locking finger extending upwardly therefrom. The locking bar provides a locking recess to receive a selected one of the locking fingers to hold the arm means securely in the mounting recess. The preferred configuration of the locking slots is such that each slot has a main portion, an offset entry portion, and a transitional portion connecting the entry portion with the main locking slot portion. In moving the first securing means to its locking position, the locking bar is engageable in each locking slot by passage through a related entry locking slot portion and into the main locking slot portion.

The second inner securing device comprises a pair of contact members mounted for fore and aft motion. Each contact member has an elongate resilient member connected thereto. Each resilient member has a first portion extending forwardly from the contact member around forwardly mounted pulley means, and a second portion extending from the pulley means to an anchoring point on the display unit. Thus the first and second sections of the resilient member exert a forwardly directed tension force on its related inner securing device so that the tension force is distributed over both of the first and second portions of the resilient member in series relationship.

BRIEF DESCRIPTION OF THE DRAWINGS

FIG. 1 is an isometric view of the shoe display apparatus;

FIG. 2 is a top plan view of a mounting post of the apparatus shown in FIG. 1, with a pair of mounting members and their associated locking cams being shown separate from their associated display platforms;

FIG. 3 is an isometric view of a single display unit, with a locking cam and toe-securing device thereof spaced from the unit for purposes of illustration;

FIG. 4 is a side elevational view of a single display unit;

FIG. 5 is a bottom plan view of the unit shown in FIG. 4;

FIG. 6 is a side elevational view of the inner mounting portion of the display unit, with portions thereof broken away to illustrate the mounting of the locking cam;

FIG. 7 is a sectional view taken along line 7—7 of FIG. 5, showing the mounting for the heel securing unit;

DESCRIPTION OF THE PREFERRED EMBODIMENT

Figure 8:
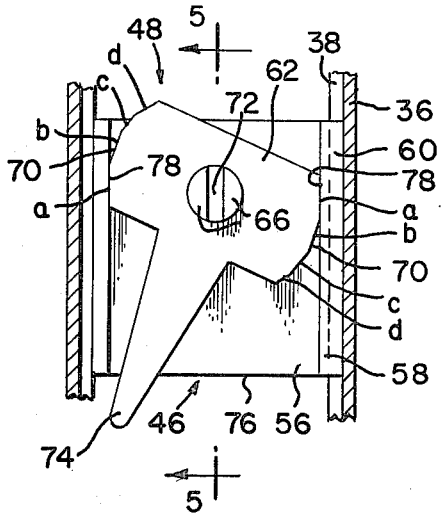
FIG. 8 is a view taken along line 8—8, and showing the locking cam of the present invention in its release position.

With reference to FIG. 1, the apparatus of the present invention, generally designated 10, can be seen to comprise an upright mounting post 12 and a plurality of display units 14. Each display unit 14 is arranged to securely hold a single pair of shoes 16 in side-by-side relationship, with the upper portion 18 of the shoes positioned upwardly. For convenience of illustration, only three display units 14 are shown in FIG. 1, but it is to be understood that a plurality of units 14 could be displayed in vertical rows to all four mounting faces 20 of the post 12.

The post 12 comprises an elongate column member 22 having a square cross sectional configuration. This column member 22 is mounted from a base plate 24 in an upright position, and if desired it can be provided with an upper cap member indicated schematically at 26.

Mounted to each face 20 of the column member 22 is a slideway member 28 to which the units 14 are directly mounted. Each slideway member 28 is mounted to its related face 20 by means of a tongue-and-groove fitting, with the tongue portions 30 being made integral with the column member 22, and the slideway members 28 being provided with groove defining flanges 32 which interfit with the tongue portions 30 in locking relationship. Each slideway member 28 comprises a base plate 34 extending the length of the column member 22, the base plate 34 having at its two vertical edges elongate U-shaped members 36 which define related vertical slots 38. These slots 38 extend the entire length of the column member 22 and face laterally toward one another.

With reference to FIG. 3, it can be seen that each display unit 14 comprises five main components, namely: a support platform 40, a toe-securing device 42, a pair of heel-securing devices 44, a mounting member 46 and a cam locking member 48.

The support platform 40 has a platform configuration generally matching the configuration of the pair of shoes 16 which are to be mounted thereon, and is divided into right and left sections 40*a* and 40*b*, separated by a center ridge 50. The platform has an outer end 52 at which the toe-securing device 42 is mounted, and an inner end 54 integrally connected to the mounting member 46. The two heel securing devices 44 are mounted one on each platform section 40*a* and 40*b* in a manner to be movable along the lengthwise axis of the platform 40 to accommodate shoes of different sizes.

In describing the platform 40 and other components of the display unit 14, the term "forward" will denote proximity to the outer end 52 of the platform 50, or will denote a direction extending from the inner end 54 to the outer end 52 thereof, and the term "rear" or "rearward" will denote proximity to the inner end 54 of the platform 40 or a direction extending from the outer end 52 to the inner end 54.

To describe more particularly the manner in which each display unit 14 is mounted to the post 12, each mounting member 46 comprises a platelike body portion 56 which is integrally secured to the inner end 54 of the platform 40. Extending rearwardly from the side edges of the platelike member 56 are a pair of vertically oriented web members 58 having at the rear edges thereof laterally and outwardly extending flanges 60. These flanges 60 fit into the aforementioned vertical slots 38 of a related slideway member 28. This can be seen more clearly with reference to FIG. 2 where one mounting member 46 is shown with its flanges 60 in mounting engagement with the slots 38. A second mounting member 46, with its locking cam 48, is shown out of engagement with the two slots 38, but in a position where it can be inserted into mounting engagement with the slots 38. For purposes of illustration, the mounting members 46 are shown with their integrally attached platforms 40.

It will be noted that the width dimension of each of the web members 58 of each mounting member 46 increases in an upward direction. This produces two desired effects. First, with the rear mounting flanges 60 mounted in a vertical position in the slots 38 of the slideway 28, the base plate portion 56 of the mounting member 46 slants to a moderate degree upwardly and away from the post 12. The result is that the platform 40 which is mounted perpendicular to the plate portion 56 extends outwardly therefrom at a moderate downward and outward slant, to position the platform 40 at an angle at which the shoes 16 placed thereon can be better viewed. A second benefit to be derived from this particular configuration of the web members 58 of the mounting member 46 is that the upper portions of the flanges 60 can be more readily pressed outwardly into locking engagement in the mounting slots 38. The significance of this will become more apparent from the following description of the locking cam member 48.

This cam member 48 has a main plate or body portion 62 having a forwardly extending mounting sleeve 64 by which it is pivotally mounted on a pair of boss members 66 extending rearwardly from the base portion 56 of the mounting member 46. These boss members 66 are provided with outwardly protruding lips 68 at the rear ends thereof to retain the cam member 48 on the boss member 66.

Figure 9:
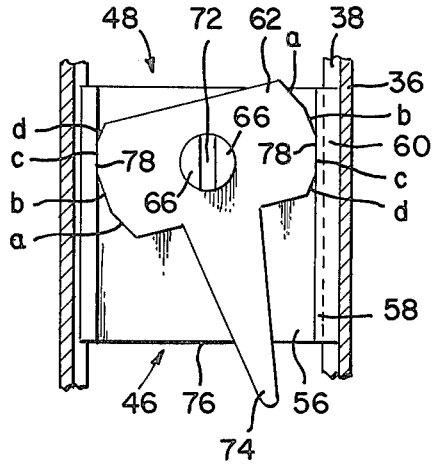
FIG. 9 is a view similar to FIG. 8 taken along line 9—9, showing the cam in its locking position.

The two side edges of the cam member 48 are formed as identical cam surfaces 70. With reference to FIGS. 8 and 9, it can be seen that each cam surface 70 is formed as four distinct flat portions, designated "a", "b", "c" and "d", positioned in matching opposed sets. The first opposite set of cam surface portions "a" are positioned closest to the center mounting point 72 of the cam member 48, the next adjacent portions "b" being slightly further from the center point 72, the next cam surface portions "c" being yet further from the center point 72 by a moderate distance, and finally the cam surface portions "d" being the furthest from the center point 72. Extending downwardly from the lower edge of the cam member 48 is an operating lever 74. This lever 74 extends moderately below the lower edge 76 of the mounting member 46, so that it is inconspicuously positioned, yet readily available for operating the cam member 48.

The cam member 48 is positioned in the upper part of the mounting member 46, with the cam surfaces 70 engaging the upper inside rear surface portions 78 of the web members 58 of the mounting member 46. In this regard, the mounting sleeve 64 serves two functions. First, it serves as a spacing element to position the cam member 48 the proper distance from the front plate portion 56 of the mounting member 46. Secondly, it stabilizes the rotational movement of the cam member 48 about the boss members 66 so that the cam surfaces 70 remain in proper engagement with the web members 58.

The cam member 48 has a release position and a locking position. As shown in FIG. 8, the operating lever 74 has been pushed to a position where the most inwardly positioned cam surface portions "a" are in engagement with the web members 58. In the position of FIG. 9, the operating lever 74 has been moved to a position where the cam surface portions "c" engage the web members 58 and thus spread the web portions 58 further from one another to press the mounting flanges 60 further outwardly into the mounting slots 38. The cam surfaces 70 are so dimensioned, relative to the dimensions of the flanges 60 and the mounting slots 38 that in the position of FIG. 8, with the cam surfaces "a" engaging the web members 58, the flanges 60 are in sufficiently loose engagement in the slots 38 that the mounting member 46 can be moved free of the slots 38 of the slideway member 28, as shown in FIG. 2. However, when the lever 74 is moved from the position in FIG. 8 toward the position in FIG. 9, the cam surfaces 70 spread the flanges 60 into locking engagement in the slots 38. In the position of FIG. 9, the cam surface portions "c" are in engagement with the web members 58 to lock the mounting member 46 in place.

It is to be understood, however, that there will be some variation in the dimensions of the component parts, due to manufacturing tolerances, and if a greater spreading of the web members 58 is desired for proper locking engagement in the slots 38, the cam member 48 can be rotated further into the position where cam surface portions "d" are in contact with the web members 58. On the other hand, if less spreading is desired for proper locking engagement, the cam surface portions "c" or "b" will be in engagement with the web members 58.

Each heel securing device 44 comprises an upstanding contact member 78 contoured to properly engage the heel portion of a shoe 16. This contact member 78 is connected to a base plate 79 mounted in a slightly recessed portion 80 on the upper surface of the platform 40 for fore and aft motion on the platform 40. A keying element 81 is attached to the lower side of each base plate 79 and fits in a related elongate keying slot 82. Each keying slot 82 has an enlarged rear access portion 84 through which the keying element 80 can be inserted in initially mounting the heel securing device 44 and a narrower forward portion 86 which retains the keying element 81 on the bottom side of the platform 40 while permitting fore and aft slide motion of the heel securing device 44 along the length of the forward slot portion 86.

To urge each of the contact members 78 of the two heel securing devices 44 forwardly to properly engage the heel portions of a pair of shoes 16, each heel securing device 44 is provided with an elongate resilient tension member such as a rubber band 88 positioned on the bottom side of the platform 40. With reference to FIG. 5, it can be seen that one end 90 of the rubber band 88 is connected to a related keying element 80, which is grooved at 91 to retain the rubber band 88. The rubber band 88 extends forwardly from its related keying element 80 to reach around a related one of two freely rotating pulleys 92 mounted at the bottom side of the forward end of the platform 40. From the pulley 92 the rubber band extends rearwardly to connect to a related stationary base point 94 on the bottom side of the platform 40 rearwardly of the location of the pulleys 92.

Thus, each rubber band 88 is provided with two stretchable sections 88*a* and 88*b*, arranged in series with one another by means of the mounting around the pulley 92. This arrangement permits each heel securing device 44 to move substantially the entire length of its related keying slot 82 with a lesser degree of variation in the tension provided by each rubber band 88 than would be possible in other arrangements where the two rubber band sections are arranged in parallel rather than in series.

The toe securing device 42 comprises a center mounting portion 96 to which are mounted two oppositely extending contact members 98, each of which is positioned to properly engage a related toe portion of one of the shoes 16. Extending rearwardly from the mounting portion 96 is a vertically positioned arm means 100 which fits in a vertical mounting recess 101 defined by a pair of plates 102 extending forwardly from the middle of the front end portion of the platform 40.

The arm means 100 is provided with a plurality (three, as shown herein) of horizontal, vertically spaced slots 104 which separate the arm means 100 into four individual arm elements 106. The lower three arm elements 106 each have at the rear ends thereof an upstanding finger 108. The lower rear end of each of the upper three arm elements 106 has a cut-out 110 reaching moderately above the level of its related slot 104. The effect of this arrangement is that each vertically adjacent set of arm elements 106 defines a slot configuration comprising a main slot portion 104, an entry portion 112 offset in an upward direction moderately from the main slot portion 104, and a transitional slot portion 114 connecting the two slot portions 104 and 112. The arm means 100 is formed of a plastic material which is sufficiently resilient to permit each adjacent pair of arm elements 106 to be spread moderately from each other in a vertical direction.

So that the arm means 100 can be held securely within the mounting plates 102, there is provided a crossbar 116 extending between the two mounting plates 102. The thickness dimension (i.e., vertical dimension) of this crossbar 116 is substantially the same as that of each of the main slot portions 104. The rear edge of the crossbar 116 is spaced in short distance forward from the rear connecting portion 118 of the mounting plates 102 to leave a locking recess 120 having substantially the same dimensions as each of the fingers 108.

Figure 10:
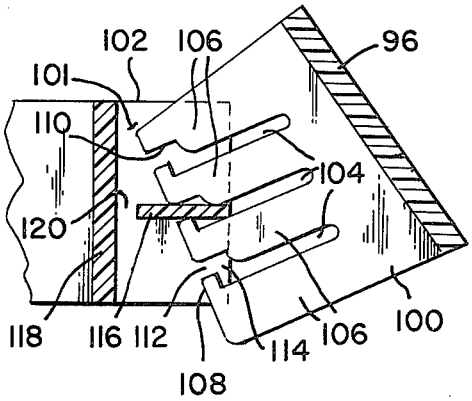
FIG. 10 is a sectional view of the mounting member for the toe-securing device of the present invention in an intermediate position where it is coming into locking engagement.

The manner in which the toe securing device 42 is mounted to the platform 40 in the desired position is best explained with reference to FIGS. 10 and 11. As shown in FIG. 10, the arm means 100 is being moved into the slot 101 defined by the plates 102 so that the middle slot 104 is coming into engagement with the crossbar 116. As the arm means 100 is moved further rearwardly, the crossbar 116 moves through the slot entry portion 112 and through the transitional portion 114 to spread the adjacent arm members 106 moderately away from each other. With further rearward movement of the arm means 100, the crossbar 116 moves entirely within the main slot portion 104, with the upstanding finger 108 from the lower adjacent arm element 106 fitting into the locking recess 118.

Figure 11:
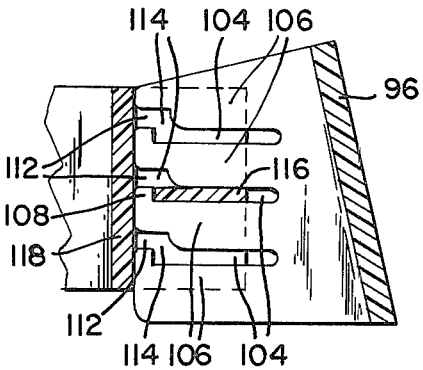
FIG. 11 is a view similar to FIG. 10, but showing the mounting member of the toe-securing device in its fully engaged position.

In the secured position, shown in FIG. 11, any forward pressure exerted against the contact members 98 would tend to rotate the arm means 100 in a clockwise direction, as seen in FIG. 11. This would tend to bring the securing finger 108 into yet better engagement with its related securing recess 120 so as to resist any tendency for the arm means 100 to disengage from its location between the mounting plates 102.

To remove the toe securing device 42 from its secured location between the mounting plates 102, the mounting portion 96 is rotated slightly in a counterclockwise direction, as seen in FIG. 11, to cause the crossbar 116 to deflect the upper adjacent arm element 106 upwardly, and move the securing finger 108 out of engagement with the securing recess 120. In this position, the toe-securing device 42 can be moved forwardly with the crossbar 116 passing through the slot portions 114 and 112. Then, the toe-securing device 42 can be moved to either a higher or lower position by selecting one of the other mounting slots 104 for engagement with the crossbar 116.

To summarize the mode of operation of the present invention, each display unit 14 can be mounted to the post 12, simply by moving the related locking cam member 48 to its release position, as shown in FIG. 8. Then the mounting member 46 of the display unit 14 can easily be slipped into engagement with a related slideway member 28 by moving the mounting flanges 46 into engagement with the vertical mounting slots 38 of the slideway member 28, as shown in FIG. 2. Prior to moving the cam member 48 into locking engagement, the mounting member 46 with the display unit 14 can be moved vertically along the slideway 28 to the desired position. Then the operating lever 74 of the locking cam member 48 is rotated to its locking position, as shown in FIG. 9, to spread the mounting flanges 60 outwardly into locking engagement in the mounting slots 38.

With the cam surfaces 70 engaging the upper portions of the web members 58, it is the upper portion of the mounting flanges 60 which are pressed more securely into engagement with their related slots 38. Since the loading of the shoes 16 on the platform 40 would tend to deflect the outer portion of the platform 40 downwardly, this exerts a force which tends to move the upper portion of the mounting flanges 60 forwardly out of the mounting slots 38. Thus, the cam member 48, in addition to providing locking engagement of the flanges 60, also exerts its spreading force on the flanges 60 at the optimum location to provide more secure mounting of the display unit 14.

To remove the display unit 14 from the post 12, the reverse procedure is followed, in that the cam operating lever 74 is moved to its opposite release position, and the mounting member 46 is simply moved out of engagement with its related slideway member 28.

As indicated earlier herein, the toe securing device 42 is vertically adjustable to accommodate shoes of different dimensions. The vertical position of the toe securing device 42 is quite easily changed by selecting the proper mounting slot 104 for engagement with the crossbar 116, as shown in FIGS. 10 and 11. As indicated earlier herein, the particular configuration of the main slot portion 104, the slot entry portion 112, and intermediate portion 114, is such that the arm means 100 is held in secure relationship between the mounting plates 102, with the securing finger 108 preventing inadvertent disengagement. Yet, the toe securing device can be quite easily moved to a disengaged position, simply by rotating the toe securing device 42 slightly so that the upper portion thereof is moved rearwardly, thus freeing the securing finger 108 from engagement in the securing recess 118.

With the several display units 14 properly positioned, and with their toe securing devices in the proper vertical location, a shoe 16 can quite easily be placed into its display position, simply by placing the heel portion thereof against the contact member 78 of one of the heel securing devices 44, then moving it rearwardly until the toe portion of the shoe 16 fits behind its related contact member 98 of the toe securing device 42, and then releasing the shoe. The particular arrangement of the resilient rubber band 88 (see FIG. 5) provides a tension force on the heel contact member 78 which is subject to a relatively small degree of variation.

What is claimed is:

1. A display apparatus particularly adapted to display articles, such as pairs of shoes, in a manner that the shoes of each pair are in an upright position and in side-by-side relationship, said apparatus comprising:

a. a mounting post having a longitudinal axis and providing at least one vertical slideway in the form of a pair of longitudinally extending opposed mounting slots, b. at least one display unit to be mounted to said post, said unit comprising:

1. a display platform adapted to support an article, such as a pair of shoes, thereon and having an inner end and an outer end, 2. a mounting member attached to the inner end of said platform, said mounting member having a pair of oppositely and outwardly extending mounting flanges resiliently attached to the mounting member so as to be able to be deflected outwardly into engagement in said mounting slots, 3. locking means positioned to engage said mounting flanges, said locking means having a locking position where it presses said mounting flanges outwardly into locking engagement in the mounting slots, and a release position where it releases said flanges from locking engagement in said mounting slots to permit movement of the mounting member and its associated platform relative to the mounting post, 4. a first outer securing device mounted to the outer end of the platform member by vertically-adjustable mounting means so that the outer securing device can be vertically-adjusted relative to the platform to engage in proper fashion one end of said article, such as a toe of a shoe being displayed, 5. a second inner securing device mounted to said platform at a location inwardly of the first securing device and arranged to engage an inner end of said article, such as a heel of a shoe being displayed, whereby articles of varying sizes can be attractively displayed by adjustment of the location of the platform on the mounting post, and adjustment of the outer securing device is provided for proper engagement of the article being displayed.

2. The apparatus as recited in claim 1, wherein said locking means has a plurality of locking positions by which said mounting flanges can be deflected outwardly to a greater or lesser degree to accomodate variations in the configuration of said mounting slots.

3. The apparatus as recited in claim 2, wherein said locking means comprises a cam member having opposed cam faces engaging said mounting flanges.

4. The apparatus as recited in claim 3, wherein said cam member is rotatably mounted to said mounting means, and each cam face has a plurality of opposed sets of locking faces spaced at varying distances from a point of rotation of said locking cam.

5. The apparatus as recited in claim 1, wherein said locking means comprises a locking cam rotatably mounted to said mounting member, said locking cam having a pair of opposed cam faces having a plurality of opposed sets of locking surfaces located at varying distances from a center of rotation of said locking cam, said locking cam having spacing means to properly position the locking cam relative to the mounting member for proper engagement of the mounting flanges.

6. The apparatus as recited in claim 5, wherein said locking cam is provided with a downwardly extending lever accessible from a position below said mounting means, whereby said locking cam can be conveniently moved between its locking and release positions.

7. The apparatus as recited in claim 3, wherein said locking cam is positioned at an upper portion of said mounting means, to engage upper portions of said mounting flanges, whereby said locking cam is able to press upper portions of the flanges into locking engagement with the mounting slots to provide proper support for the platform from the mounting post.

8. The apparatus as recited in claim 1, wherein said locking means engages upper portions of said mounting flanges to press the upper flange portions into firm locking engagement with said mounting slots, whereby in addition to providing proper locking engagement, said platform is mounted securely in that downward rotation of said platform would be resisted by the upper flange portions in said mounting slots.

9. The apparatus as recited in claim 1, wherein said mounting member comprises a body portion and two rearwardly extending webs having said laterally extending mounting flanges mounted at rear edge portions of said webs, said webs being resiliently mounted to permit outward deflection of said mounting flanges, said locking means comprising a locking cam rotatably mounted to said mounting means at an upper portion thereof, said locking cam providing a pair of opposed cam faces having opposed pairs of locking surfaces adapted to engage said mounting flanges at varying distances from a center point of rotation of said locking cam, whereby said mounting flanges can be pressed outwardly into a locking engagement regardless of variations in width dimensions between opposed mounting slots.

10. The apparatus as recited in claim 1, wherein the vertically adjustable mounting means for the outer securing device comprises a pair of vertical plates connected to said platform and defining therebetween a vertical mounting recess, a locking bar mounted across said mounting recess, arm means connected to said outer securing device and adapted to fit into said mounting recess, said arm means being provided with a plurality of vertically spaced locking slots which may be selectively engaged by said locking bar for vertical adjustment in the mounting of said outer securing device.

11. The apparatus as recited in claim 10, wherein said locking slots separate said arm means into individual arm members, some of said arm members being provided with a related locking finger extending laterally therefrom, said locking bar providing a locking recess to receive one of said locking fingers to hold said arm means securely in said mounting recess.

12. The apparatus as recited in claim 11, wherein said locking slots each have a width dimension substantially the same as said locking bar for firm engagement therewith, and each of said locking fingers defines with an adjacent locking arm a slot portion offset with respect to its related locking slot, whereby said locking bar is held securely in a related locking slot.

13. The apparatus as recited in claim 1, wherein said outer securing device comprises a pair of laterally spaced contact members adapted to engage outer ends of articles to be displayed, such as toe ends of a pair of shoes, and said vertically adjustable mounting means comprises a centrally located rearwardly extending mounting arm means connected to the outer securing device, and a pair of vertical plates connected to the platform and defining a vertical mounting recess to receive the mounting arm means, said arm means being provided with a plurality of vertically spaced locking slots, each of said slots having a main portion, an offset entry portion, and a transitional portion connecting the entry portion with the main locking slots portion, a locking bar extending across said locking recess, said locking bar being engageable in each of said locking slots by passage through a related entry locking slot portion and into said main locking slot portion.

14. The apparatus as recited in claim 13, wherein said arm means is made of a moderately resilient material such that individual arm members formed by said spaced locking slots are able to be deflected vertically from one another to to permit passage of said locking bar through said transitional portions of the locking slots, with said arms engaging said locking bar in locking engagement.

15. The apparatus as recited in claim 14, wherein at least some of said arm members have at outer ends thereof an upwardly extending locking finger, and said locking bar defines a locking slot to accommodate a related locking finger therein to hold said arm means in firm engagement.

16. The apparatus as recited in claim 1, wherein said second inner securing device comprises a contact member mounted for fore and aft motion to said platform, said second inner securing device having at least one elongate resilient member connected thereto, said resilient member having a first portion extending forwardly therefrom around forwardly mounted pulley means, and a second portion extending from said pulley means to an anchoring point on said display unit, whereby the first and second sections of said resilient member exert a forwardly directed tension force on said second inner securing device that is distributed over both of the first and second portions of the resilient member in series relationship.

17. The apparatus as recited in claim 16, wherein said second inner securing device comprises two contact members each of which has a related resilient member connected thereto and having first and second portions extending around related pulley means to a related anchoring point.

18. The apparatus as recited in claim 1, wherein:

a. said mounting member comprises a body portion and two rearwardly extending webs having said laterally extending mounting flanges mounted at rear edge portions of said webs, said webs being resiliently mounted to permit outward deflection of said mounting flanges, said locking means comprising a locking cam rotatably mounted to said mounting means at an upper portion thereof, said locking cam providing a pair of opposed cam faces having opposed pairs of locking surfaces adapted to engage said mounting flanges at varying distances of a center part of rotation of said locking cams, whereby said mounting flanges can be pressed outwardly into a locking engagement regardless of variations in width dimensions between opposed mounting slots, b. said outer securing device comprises a pair of laterally spaced contact members adapted to engage outer ends of articles to be displayed, such as toe ends of a pair of shoes, and said vertically adjustable mounting means comprises a centrally located rearwardly extending mounting arm means connected to the outer securing device, and a pair of vertical plates connected to the platform and defining a vertical mounting recess to receive the mounting arm means, said arm means being provided with a plurality of vertically spaced locking slots, each of said slots having a main portion, an offset entry portion, and a transitional portion connecting the entry portion with the main locking slot portion, a locking bar extending across said locking recess, said locking bar being engageable in each of said locking slots by passage through a related entry locking slot portion and into said main locking slot portion.

19. The apparatus as recited in claim 18, wherein said arm means is made of a moderately resilient material such that individual arm members formed by said spaced locking slots are able to be deflected vertically from one another to permit passage of said locking bar through said transitional portions of the locking slots, with said arms engaging said locking bar in locking engagement.

20. The apparatus as recited in claim 19, wherein at least some of said arm members have at outer ends thereof an upwardly extending locking finger, and said locking bar defines a locking slot to accommodate a related locking finger therein to hold said arm means in firm engagement.

21. A mounting assembly adapted to mount a movable structure, such as an adjustable display platform, to a base structure, such as a mounting post, said mounting assembly comprising:

a. a slideway mounted to said base structure and defining a pair of longitudinally extending opposed mounting slots, b. a mounting member attached to said movable structure, said mounting member having a pair of oppositely and outwardly extending mounting flanges resiliently attached to the mounting member so as to be able to be deflected outwardly into engagement in said mounting slots, c. a locking cam member having a locking position where it presses said mounting flanges outwardly into locking engagement in the mounting slots, and a release position where it releases said flanges from locking engagement in said mounting slots to permit movement of the mounting member relative to the base structure, d. said locking cam having opposed cam faces engaging said mounting flanges, said cam member being rotatably mounted to said cam means, each cam face having opposed sets of locking faces having varying distances from a point of rotation of said locking cam, whereby said mounting flanges can be deflected outwardly to a greater or lesser degree to accommodate variations in the configuration of said mounting slots.

22. The mounting assembly as recited in claim 21, wherein said locking cam is positioned at an upper location of said mounting means, to engage upper portions of said mounting flanges, whereby said locking cam is able to press upper portions of the flanges into locking engagement with the mounting slots to provide proper support from the base structure.

23. The assembly as recited in claim 22, wherein said mounting member comprises a body portion and two rearwardly extending webs having said laterally extending mounting flanges mounted at rear edge portions of said webs, said webs being resiliently mounted to permit outward deflection of said mounting flanges, said opposed cam faces engaging outer serves of said webs to urge said mounting flanges outwardly upon rotation of said locking cam to its locking position.

24. In a display apparatus particularly adapted to display articles, such as pairs of shoes in a manner that the shoes of each pair are in an upright position and in side-by-side relationship, wherein said display apparatus comprises a mounting post having a longitudinal axis and providing at least one vertical slideway in the form of a pair of longitudinally extending opposed mounting slots, a display unit adapted to be mounted as one of a plurality of display units to said post, said unit comprising:

a. a display platform adapted to support an article, such as a pair of shoes, thereon and having an inner end and an outer end, b. a mounting member attached to the inner end of said platform, said mounting member having a pair of oppositely and outwardly extending mounting flanges resiliently attached to the mounting member so as to be able to be deflected outwardly into engagement in said mounting slots, c. locking means positioned to engage said mounting flanges, said locking means having a locking position where it presses said mounting flanges outwardly into locking engagement in the mounting slots, and a release position where it releases said flanges from locking engagement in said mounting slots to permit movement of the mounting member and its associated platform relative to the mounting post, d. a first outer securing device mounted to the outer end of the platform member by vertically-adjustable mounting means so that the outer securing device can be vertically-adjusted relative to the platform to engage in proper fashion one end of said article, such as a toe of a shoe being displayed, e. a second inner securing device mounted to said platform at a location inwardly of the first securing device and arranged to engage an inner end of said article, such as a heel of a shoe being displayed, whereby articles of varying sizes can be attractively displayed by adjustment of the location of the platform on the mounting post, and adjustment of the outer securing device is provided for proper engagement of the article being displayed.

25. The apparatus as recited in claim 24, wherein said locking means has a plurality of locking positions by which said mounting flanges can be deflected outwardly to a greater or lesser degree to accommodate variations in the configuration of said mounting slots.

26. The apparatus as recited in claim 25, wherein said locking means comprises a cam member having opposed cam faces engaging said mounting flanges.

27. The apparatus as recited in claim 26, wherein said cam member is rotatably mounted to said mounting means, and each cam face has a plurality of opposed sets of locking faces spaced at varying distances from a point of rotation of said locking cam.

28. The apparatus as recited in claim 24, wherein said locking means comprises a locking cam rotatably mounted to said mounting member, said locking cam having a pair of opposed cam faces having a plurality of opposed sets of locking surfaces located at varying distances from a center of rotation of said locking cam, said locking cam having spacing means to properly position the locking cam relative to the mounting member for proper engagement of the mounting flanges.

29. The apparatus as recited in claim 28, wherein said locking cam is provided with a downwardly extending lever accessible from a position below said mounting means, whereby said locking cam can be conveniently moved between its locking and release positions.

30. The apparatus as recited in claim 26, wherein said locking cam is positioned at an upper portion of said mounting means, to engage upper portions of said mounting flanges, whereby said locking cam is able to press upper portions of the flanges into locking engagement with the mounting slots to provide proper support for the platform from the mounting post.

31. The apparatus as recited in claim 24, wherein said locking means engages upper portions of said mounting flanges to press the upper flange portions into firm locking engagement with said mounting slots, whereby in addition to providing proper locking engagement, said platform is able to be mounted securely in that downward rotation of said platform would be resisted by the upper flange portions in said mounting slots.

32. The apparatus as recited in claim 24, wherein said mounting member comprises a body portion and two rearwardly extending webs having said laterally extending mounting flanges mounted at rear edge portions of said webs, said webs being resiliently mounted to permit outward deflection of said mounting flanges, said locking means comprising a locking cam rotatably mounted to said mounting means at an upper portion thereof, said locking cam providing a pair of opposed cam faces having opposed pairs of locking surfaces adapted to engage said mounting flanges at varying distances from a center point of rotation of said locking cams, whereby said mounting flanges can be pressed outwardly into a locking engagement regardless of variations in width dimensions between opposed mounting slots.

33. The apparatus as recited in claim 24, wherein the vertically adjustable mounting means for the outer securing device comprises a pair of vertical plates connected to said platform and defining therebetween a vertical mounting recess, a locking bar mounted across said mounting recess, arm means connected to said outer securing device and adapted to fit into said mounting recess, said arm means being provided with a plurality of vertically spaced locking slots which may be selectively engaged by said locking bar for vertical adjustment in the mounting of said outer securing device.

34. The apparatus as recited in claim 33, wherein said locking slots separate said arm means into individual arm members, some of said arm members being provided with a related locking finger extending laterally therefrom, said locking bar providing a locking recess to receive one of said locking fingers to hold said arm means securely in said mounting recess.

35. The apparatus as recited in claim 34, wherein said locking slots each have a width dimension substantially the same as said locking bar for firm engagement therewith, and each of said locking fingers defines with an adjacent locking arm a slot portion offset with respect to its related locking slot, whereby said locking bar is held securely in a related locking slot.

36. The apparatus as recited in claim 24, wherein said outer securing device comprises a pair of laterally spaced contact members adapted to engage outer ends of articles to be displayed, such as toe ends of a pair of shoes, and said vertically adjustable mounting means comprises a centrally located rearwardly extending mounting arm means connected to the outer securing device, and a pair of vertical plates connected to the platform and defining a vertical mounting recess to receive the mounting arm means, said arm means being provided with a plurality of vertically spaced locking slots, each of said slots having a main portion, an offset entry portion, and a transitional portion connecting the entry portion with the main locking slots portion, a locking bar extending across said locking recess, said locking bar being engageable in each of said locking slots by passage through a related entry locking slot portion and into said main locking slot portion.

37. The apparatus as recited in claim 36, wherein said arm means is made of a moderately resilient material such that individual arm members formed by said spaced locking slots are able to be deflected vertically from one another to permit passage of said locking bar through said transitional portions of the locking slots, with said arms engaging said locking bar in locking engagement.

38. The apparatus as recited in claim 37, wherein at least some of said arm members have at outer ends thereof an upwardly extending locking finger, and said locking bar defines a locking slot to accommodate a related locking finger therein to hold said arm means in firm engagement.

39. The apparatus as recited in claim 24, wherein said second inner securing device comprises a contact member mounted for fore and aft motion to said platform, said second inner securing device having at least one elongate resilient member connected thereto, said resilient member having a first portion extending forwardly therefrom around forwardly mounted pulley means, and a second portion extending from said pulley means to an anchoring point on said display unit, whereby the first and second sections of said resilient member exert a forwardly directed tension force on said second inner securing device that is distributed over both of the first and second portions of the resilient member in series relationship.

40. The apparatus as recited in claim 39, wherein said second inner securing device comprises two contact members each of which has a related resilient member connected thereto and having first and second portions extending around related pulley means to a related anchoring point.

41. The apparatus as recited in claim 24, wherein:

a. said mounting member comprises a body portion and two rearwardly extending webs having said laterally extending mounting flanges mounted at rear edge portions of said webs, said webs being resiliently mounted to permit outward deflection of said mounting flanges, said locking means comprising a locking cam rotatably mounted to said mounting means at an upper portion thereof, said locking cam providing a pair of opposed cam faces having opposed pairs of locking surfaces adapted to engage said mounting flanges at varying distances of a center part of rotation of said locking cams, whereby said mounting flanges can be pressed outwardly into a locking engagement regardless of variations in width dimensions between opposed mounting slots, b. said outer securing device comprises a pair of laterally spaced contact members adapted to engage outer ends of articles to be displayed, such as toe ends of a pair of shoes, and said vertically adjustable mounting means comprises a centrally located rearwardly extending mounting arm means connected to the outer securing device, and a pair of vertical plates connected to the platform and defining a vertical mounting recess to receive the mounting arm means, said arm means being provided with a plurality of vertically spaced locking slots, each of said slots having a main portion, an offset entry portion, and a transitional portion connecting the entry portion with the main locking slot portion, a locking bar extending across said locking recess, said locking bar being engageable in each of said locking slots by passage through a related entry locking slot portion and into said main locking slot portion.

42. The apparatus as recited in claim 41, wherein said arm means is made of a moderately resilient material such that individual arm members formed by said spaced locking slots are able to be deflected vertically from one another to permit passage of said locking bar through said transitional portions of the locking slots, with said arms engaging said locking bar in locking engagement.

43. The apparatus as recited in claim 42, wherein at least some of said arm members have at outer ends thereof an upwardly extending locking finger, and said locking bar defines a locking slot to accommodate a related locking finger therein to hold said arm means in firm engagement.

* * * * *